US008703669B2

(12) United States Patent
Iyer

(10) Patent No.: US 8,703,669 B2
(45) Date of Patent: Apr. 22, 2014

(54) ULTRA-LOW SULFUR CLUTCH-ONLY TRANSMISSION FLUIDS

(75) Inventor: Ramnath N. Iyer, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 12/372,206

(22) Filed: Feb. 17, 2009

(65) Prior Publication Data

US 2009/0233822 A1 Sep. 17, 2009

Related U.S. Application Data

(60) Provisional application No. 61/035,505, filed on Mar. 11, 2008.

(51) Int. Cl.
*C10M 159/24* (2006.01)
*C10M 169/04* (2006.01)
*C07F 9/02* (2006.01)

(52) U.S. Cl.
USPC ..... 508/187; 508/391; 508/564

(58) Field of Classification Search
USPC ..... 508/363, 187, 391, 564, 171
See application file for complete search history.

(56) References Cited

U.S. PATENT DOCUMENTS

| | | | |
|---|---|---|---|
| 2,284,409 | A | 5/1942 | Erath |
| 2,284,410 | A | 5/1942 | Farmer |
| 2,459,112 | A | 1/1949 | Oberright |
| 2,962,442 | A | 1/1960 | Andress |
| 2,984,550 | A | 5/1961 | Chamot |
| 3,036,003 | A | 5/1962 | Verdol |
| 3,087,936 | A | 4/1963 | Le Suer |
| 3,166,516 | A | 1/1965 | Kirkpatrick |
| 3,172,892 | A | 3/1965 | Le Suer et al. |
| 3,202,678 | A | 8/1965 | Stuart |
| 3,216,936 | A | 11/1965 | Le Suer |
| 3,219,666 | A | 11/1965 | Norman |
| 3,236,770 | A | 2/1966 | Matson |
| 3,254,025 | A | 5/1966 | Le Suer |
| 3,272,746 | A | 9/1966 | Le Suer |
| 3,275,554 | A | 9/1966 | Wagenaar |
| 3,281,428 | A | 10/1966 | Le Suer |
| 3,282,955 | A | 11/1966 | Le Suer |
| 3,329,658 | A | 7/1967 | Fields |
| 3,331,776 | A | 7/1967 | Krukziener |
| 3,338,832 | A | 8/1967 | Le Suer |
| 3,344,069 | A | 9/1967 | Stuebe |
| 3,368,972 | A | 2/1968 | Otto |
| 3,381,022 | A | 4/1968 | Le Suer |
| 3,394,576 | A | 7/1968 | Shumaker |
| 3,413,347 | A | 11/1968 | Worrel |
| 3,438,757 | A | 4/1969 | Honnen |
| 3,442,808 | A | 5/1969 | Traise |
| 3,448,047 | A | 6/1969 | Traise |
| 3,449,250 | A | 6/1969 | Fields |
| 3,454,497 | A | 7/1969 | Wittner |
| 3,454,555 | A | 7/1969 | van der Voort |
| 3,459,661 | A | 8/1969 | Schlobohm |
| 3,493,520 | A | 2/1970 | Verdol |
| 3,519,565 | A | 7/1970 | Coleman |
| 3,522,179 | A | 7/1970 | Le Suer |
| 3,533,945 | A | 10/1970 | Vogel |
| 3,539,633 | A | 11/1970 | Piasek |
| 3,558,743 | A | 1/1971 | Verdol et al. |
| 3,565,804 | A | 2/1971 | Honnen |
| 3,586,629 | A | 6/1971 | Otto |
| 3,591,598 | A | 7/1971 | Traise |
| 3,600,372 | A | 8/1971 | Udelhofen |
| 3,634,515 | A | 1/1972 | Piasek |
| 3,649,229 | A | 3/1972 | Otto |
| RE27,331 | E | 4/1972 | Coleman |
| 3,658,836 | A | 4/1972 | Vineyard |
| 3,666,730 | A | 5/1972 | Coleman |
| 3,671,511 | A | 6/1972 | Honnen et al. |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek |
| 3,704,308 | A | 11/1972 | Piasek |
| 3,718,663 | A | 2/1973 | Piasek et al. |
| 3,725,277 | A | 4/1973 | Worrel |
| 3,725,480 | A | 4/1973 | Traise et al. |
| 3,726,882 | A | 4/1973 | Traise |
| 3,736,357 | A | 5/1973 | Piasek |
| 3,751,365 | A | 8/1973 | Piasek |
| 3,756,953 | A | 9/1973 | Piasek |
| 3,793,202 | A | 2/1974 | Piasek et al. |
| 3,798,165 | A | 3/1974 | Piasek |
| 3,798,247 | A | 3/1974 | Piasek |
| 3,803,039 | A | 4/1974 | Piasek et al. |
| 3,821,302 | A | 6/1974 | Hu |
| 3,872,019 | A | 3/1975 | Culbertson et al. |
| 3,904,595 | A | 9/1975 | Plonsker et al. |
| 3,957,746 | A | 5/1976 | Malec |
| 3,980,569 | A | 9/1976 | Pindar et al. |
| 3,985,802 | A | 10/1976 | Piasek et al. |
| 4,006,089 | A | 2/1977 | Chibnik |
| 4,011,380 | A | 3/1977 | West et al. |
| 4,025,451 | A | 5/1977 | Plonsker et al. |

(Continued)

FOREIGN PATENT DOCUMENTS

| | | |
|---|---|---|
| EP | 1 739 159 | 1/2007 |

*Primary Examiner* — Vishal Vasisth
(74) *Attorney, Agent, or Firm* — Luedeka Neely Group, P.C.

(57) ABSTRACT

The present disclosure provides a fluid for lubricating the clutch-only portion of a wet clutch in a dual clutch transmission. The fluid provides high dynamic friction durability and comprises an oil of lubricating viscosity formulated with additive components comprising: i) at least one metal detergent; ii) at least one phosphorus-based wear preventative; iii) a phosphorylated and boronated dispersant different than the at least one phosphorus-based wear preventative; iv) a sulfurized extreme pressure agent; and a ratio between the content (ppm) of the sulfur based on the total weight of the fluid composition and a content (ppm) of phosphorus based on the total weight of the fluid composition ranging from about 2.0 to about 0.5 (ppm/ppm).

11 Claims, No Drawings

(56) References Cited

U.S. PATENT DOCUMENTS

| | | | | |
|---|---|---|---|---|
| 4,058,468 | A | 11/1977 | Malec | |
| 4,083,699 | A | 4/1978 | Chibnik | |
| 4,090,854 | A | 5/1978 | Davis | |
| 4,105,571 | A | 8/1978 | Shaub et al. | |
| 4,149,982 | A | 4/1979 | Lee et al. | |
| 4,234,435 | A | 11/1980 | Meinhardt et al. | |
| 4,354,950 | A | 10/1982 | Hammond et al. | |
| 4,455,243 | A | 6/1984 | Liston | |
| 4,485,023 | A | 11/1984 | Serres et al. | |
| 4,591,645 | A | 5/1986 | Hugo et al. | |
| 4,652,387 | A | 3/1987 | Andress, Jr. et al. | |
| 2005/0059561 | A1* | 3/2005 | Ozbalik et al. | 508/434 |
| 2007/0111906 | A1* | 5/2007 | Milner et al. | 508/343 |

* cited by examiner

ULTRA-LOW SULFUR CLUTCH-ONLY TRANSMISSION FLUIDS

RELATED APPLICATIONS

This application claims the benefit of priority to U.S. Provisional Application No. 61/035,505, filed on Mar. 11, 2008.

FIELD

The present disclosure relates to lubricating fluid compositions for use in the clutch-only portion of dual clutch transmissions. The fluid compositions have enhanced dynamic friction durability and bearing protection.

BACKGROUND

Dual clutch transmissions (DCTs) have an automatic direct-shifting gearbox (DSG) with an integrated dual clutch. These transmissions are designed to deliver good driver acceptance in combination with better fuel economy than step type automatic transmissions. Coordination of the manual transmission gears is achieved through the use of dual wet clutches. As a result, performance requirements of fluids for such transmissions require elements critical for both manual transmissions (such as extreme pressure and synchronization demands) and automatic transmissions (such as steel-on-friction material performance and friction durability demands). A variation of this transmission system is one where the dual wet clutches and the direct-shifting gearbox have separate oil cycles. In such a system, the wet clutches use a "clutch-only" fluid with different performance requirements than those described above. The presently disclosed embodiments provide fluids that provide enhanced performance in the wet clutches and meet the unique demands of this "clutch-only" fluid.

SUMMARY

In accordance with the disclosure, a clutch-only fluid composition for the clutch-only portion of a dual clutch transmission may comprise an oil of lubricating viscosity formulated with additive components comprising: i) at least one metal detergent; ii) at least one phosphorus-based wear preventative; iii) a phosphorylated and boronated dispersant different than the at least one phosphorus-based wear preventative; iv) a sulfurized extreme pressure agent; and a ratio between the content (ppm) of the sulfur based on the total weight of the fluid composition and a content (ppm) of phosphorus based on the total weight of the fluid composition ranging from about 2.0 to about 0.5 (ppm/ppm).

In some embodiments, the clutch-only transmission fluid will further comprise a ratio between the content (ppm) of the sulfur based on the total weight of the fluid composition and a content (ppm) of calcium based on the total weight of the fluid composition ranging from about 10.0 to about 0.5 (ppm/ppm).

In some embodiments, the clutch-only transmission fluid may further comprise a ratio between the content (ppm) of the sulfur based on the total weight of the fluid composition and a content (ppm) of boron based on the total weight of the fluid composition ranging from about 4.0 to about 1.5 (ppm/ppm).

In some embodiments, the clutch-only transmission fluid may comprise a metal detergent selected from the group consisting of calcium phenates, calcium salicylates, calcium sulfonates, and mixtures thereof.

In some embodiments, the clutch-only transmission fluid may comprise an overbased calcium sulfonate detergent.

In some embodiments, the clutch-only transmission fluid may comprise an overbased calcium sulfonate detergent having a total base number of between about 150 to about 450.

In some embodiments, the clutch-only transmission fluid may comprise a phosphorus-based wear preventative comprising at least one dioleylphosphite compound.

In some embodiments, the clutch-only transmission fluid may comprise at least one dioleylphosphite compound providing from about 50 to about 100 ppm phosphorus.

In some embodiments, the clutch-only transmission fluid may comprise from about 50 to about 250 ppm boron from a phosphorylated and boronated dispersant.

In some embodiments, the clutch-only transmission fluid has a $\mu 20/\mu 250$ (aged) between about 0.95 and 1.05.

In another embodiment, a method for improving the friction performance of a clutch-only transmission may comprise: (1) adding to the clutch-only portion of the transmission a fluid composition comprising an oil of lubricating viscosity formulated with additive components comprising: i) at least one metal detergent; ii) at least one phosphorus-based wear preventative; iii) a phosphorylated and boronated dispersant different than the at least one phosphorus-based wear preventative; iv) a sulfurized extreme pressure agent; and a ratio between the content (ppm) of the sulfur based on the total weight of the fluid composition and a content (ppm) of phosphorus based on the total weight of the fluid composition ranging from about 2.0 to about 0.5 (ppm/ppm); and (2) operating the transmission.

In another embodiment, a clutch-only additive package may comprise: a) at least one metal detergent; b) at least one phosphorus-based wear preventative; c) a phosphorylated and boronated dispersant different than the at least one phosphorus-based wear preventative; d) a sulfurized extreme pressure agent; and e) a ratio between the content (ppm) of the sulfur based on the total weight of the additive package and a content (ppm) of phosphorus based on the total weight of the additive package ranging from about 2.0 to about 0.5 (ppm/ppm).

In some embodiments, the clutch-only additive package may further comprise a ratio between the content (ppm) of the sulfur based on the total weight of the additive package and a content (ppm) of calcium based on the total weight of the additive package ranging from about 10.0 to about 0.5 (ppm/ppm).

In some embodiments, the clutch-only additive package may further comprise a ratio between the content (ppm) of the sulfur based on the total weight of the additive package and a content (ppm) of boron based on the total weight of the additive package ranging from about 4.0 to about 1.5 (ppm/ppm).

In yet another embodiment the present invention includes a method of improving the friction durability for a dual clutch power transmission apparatus by using an effective amount of a clutch-only transmission fluid in a clutch-only fluid reservoir in communication with the dual clutch power transmission comprising a mixture of: a major amount of a lubricating oil; a friction durability improving effective amount of an additive combination comprising: at least one metal detergent; at least one phosphorus-based wear preventative; a phosphorylated and boronated dispersant different than the at least one phosphorus-based wear preventative; a sulfurized extreme pressure agent; and wherein a ratio between the content (ppm) of the sulfur based on the total weight of the fluid composition and a content (ppm) of phosphorus based on the total weight of the fluid composition ranging from about 2.0 to about 0.5 (ppm/ppm).

In yet another embodiment the present invention includes a method of improving the friction durability for a dual clutch power transmission apparatus by using an effective amount of a clutch-only transmission fluid in a clutch-only fluid reservoir in communication with the dual clutch power transmission wherein the clutch-only transmission fluid has a μ20/μ250 (aged) of between about 0.95 and 1.05.

In yet another embodiment the present invention includes a method for lubricating a clutch-only automatic transmission component requiring lubrication, comprising: 1) adding a lubricating fluid to an clutch-only automatic transmission component requiring lubrication, said fluid comprising a) an oil of lubricating viscosity formulated with additive components comprising: i) at least one metal detergent; ii) at least one phosphorus-based wear preventative; iii) a phosphorylated and boronated dispersant different than the at least one phosphorus-based wear preventative; iv) a sulfurized extreme pressure agent; b) a ratio between the content (ppm) of the sulfur based on the total weight of the fluid composition and a content (ppm) of phosphorus based on the total weight of the fluid composition ranging from about 2.0 to about 0.5 (ppm/ppm); and 2) operating the clutch-only automatic transmission component that contains the fluid.

In yet another embodiment the present invention includes a method for lubricating a clutch-only automatic transmission component requiring lubrication, wherein the fluid further comprises: c) a ratio between the content (ppm) of the sulfur based on the total weight of the fluid composition and a content (ppm) of boron based on the total weight of the fluid composition ranging from about 4.0 to about 1.5 (ppm/ppm).

In yet another embodiment the present invention includes a method for lubricating a clutch-only automatic transmission component requiring lubrication, wherein the metal detergent is selected from the group consisting of calcium phenates, calcium salicylates, calcium sulfonates, and mixtures thereof.

In yet another embodiment the present invention includes a method for lubricating a clutch-only automatic transmission component requiring lubrication, wherein the at least one metal detergent is an overbased calcium sulfonate.

In yet another embodiment the present invention includes a method for lubricating a clutch-only automatic transmission component requiring lubrication, wherein the overbased calcium sulfonate has a total base number of between about 150 to about 450.

In yet another embodiment the present invention includes a method for lubricating a clutch-only automatic transmission component requiring lubrication, wherein the at least one phosphorus-based wear preventative comprises at least one dioleylphosphite compound.

In yet another embodiment the present invention includes a method for lubricating a clutch-only automatic transmission component requiring lubrication, wherein said fluid contains from about 50 to about 100 ppm phosphorus from the dioleylphosphite compound.

In yet another embodiment the present invention includes a method for lubricating a clutch-only automatic transmission component requiring lubrication, wherein said fluid contains from about 50 to about 250 ppm boron from the phosphorylated and boronated dispersant.

DETAILED DESCRIPTION OF EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituent in the hydrocarbyl group.

In an embodiment, a fluid composition may include a detergent, a phosphorus-based wear preventative, a dispersant, and a sulfurized extreme pressure agent. Further, the fluid composition may optionally also include other lubricant additive components including, but not limited to, one or more of an antioxidant, a rust inhibitor, an antifoam agent, a friction modifier, one or more additional dispersants, one or more additional detergents, one or more additional wear preventatives, one or more additional extreme pressure agents, a seal swell agent, a viscosity index improver, an air expulsion additive, a colorant, a corrosion inhibitor, a metal deactivator, and a pour point depressant. Additives are generally described in C. V. Smalheer et al., Lubricant Additives, pages 1-11 (1967) and in U.S. Pat. No. 4,105,571, among others. The supplemental additives include those that are commercially available.

Detergent

Embodiments may include one or more detergents. Metal-containing or ash-forming detergents function both as detergents to reduce or remove deposits and as acid neutralizers or rust inhibitors, thereby reducing wear and corrosion. Detergents generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, and typically ranging from 250 to 450 or more.

Detergents that may be used include oil-soluble neutral and overbased sulfonates, phenates, sulfurized phenates, and salicylates of a metal, particularly the alkali or alkaline earth metals, e.g., sodium, potassium, lithium, calcium, zinc, and magnesium. The most commonly used metals are calcium and magnesium, which may both be present. Mixtures of calcium and/or magnesium with sodium are also useful. Also suitable metal detergents are neutral and overbased calcium or magnesium sulfonates having a TBN of from 20 to 450 TBN, neutral and overbased calcium or magnesium phenates and sulfurized phenates having a TBN of from 50 to 450, and neutral or overbased calcium or magnesium salicylates having a TBN of from 130 to 350. Mixtures of such salts may also be used.

Examples of suitable metal-containing detergents include, but are not limited to, neutral and overbased salts such as a sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a magnesium sulfonate, a magnesium carboxylate, a magnesium salicylate, a magnesium phenate, a sulfurized magnesium phenate, a calcium sulfonate, a calcium carboxylate, a calcium salicylate, a calcium phenate, a sulfurized calcium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate. Further examples include a lithium, sodium, potassium, calcium, and magnesium salt of a hydrolyzed phosphosulfurized olefin having about 10 to about 2,000 carbon atoms or of a hydrolyzed phosphosulfurized alcohol and/or an aliphatic-substituted phenolic compound having about 10 to about 2,000 carbon atoms. Even further examples include a lithium, sodium, potassium, calcium, and magnesium salt of an aliphatic carboxylic acid and an aliphatic substituted cycloaliphatic carboxylic acid and many other similar alkali and alkaline earth metal salts of oil-soluble organic acids. A mixture of a neutral or an overbased salt of two or more different alkali and/or alkaline earth metals can be used. Likewise, a neutral and/or an overbased salt of mixtures of two or more different acids can also be used.

The amount of detergent in a fluid composition according to the disclosed embodiments that also includes a major amount of base oil may be up to about 1 wt %.

Dispersant

The dispersant may comprise a Mannich or succinimide dispersant. Further, the dispersant may be a phosphorylated, boronated, or boronated/phosphorylated dispersant. Further, the dispersant may be a boronated/phosphorylated dispersant.

As used herein the term "succinimide" is meant to encompass the completed reaction product from reaction between one or more amine, ammonia, or polyamine reactants and a hydrocarbon-substituted succinic acid or anhydride (or like succinic acylating agent), and is intended to encompass compounds wherein the product may have amide, amine, amidine, and/or salt linkages in addition to the imide linkage of the type that results from the reaction of a primary amino group and an anhydride moiety.

Alkenyl succinic acid esters and diesters of polyhydric alcohols containing 2-20 carbon atoms and 2-6 hydroxyl groups may be used in forming the phosphorus-containing ashless dispersants. Representative examples are described in U.S. Pat. Nos. 3,331,776; 3,381,022; and 3,522,179.

Hydrocarbyl polyamine dispersants that may be phosphorylated are generally produced by reacting an aliphatic or alicyclic halide (or mixture thereof) containing an average of at least about 40 carbon atoms with one or more amines, for example polyalkylene polyamines. Examples of such hydrocarbyl polyamine dispersants are described in U.S. Pat. Nos. 3,275,554; 3,394,576; 3,438,757; 3,454,555; 3,565,804; 3,671,511; and 3,821,302.

Mannich polyamine dispersants which can be used in forming the phosphorylated ashless dispersant is a reaction product of an alkyl phenol, typically having a long chain alkyl substituent on the ring, with one or more aliphatic aldehydes containing from 1 to about 7 carbon atoms (especially formaldehyde and derivatives thereof), and polyamines (especially polyalkylene polyamines). Examples of Mannich condensation products and methods for their production are described in U.S. Pat. Nos. 2,459,112; 2,962,442; 2,984.550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

Polymeric polyamine dispersants suitable for preparing phosphorylated ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300.

For example, a phosphorus-containing ashless dispersant can be formed by phosphorylating an ashless dispersant having basic nitrogen and/or at least one hydroxyl group in the molecule, such as a succinimide dispersant, succinic ester dispersant, succinic ester-amide dispersant, Mannich base dispersant, hydrocarbyl polyamine dispersant, or polymeric polyamine dispersant. Polyamine succinimides in which the succinic group contains a hydrocarbyl substituent containing at least 30 carbon atoms are described for example in U.S. Pat. Nos. 3,172,892; 3,202,678; 3,216,936; 3,219,666; 3,254,025; 3,272,746; and 4,234,435. In another embodiment, a phosphorus-containing dispersant may also be borated (or boronated). Methods that can be used for borating (or boronating) the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

The amount of dispersant in a fluid of the present disclosure, that also includes a major amount of base oil, may be within the range of about 1 to about 6 weight percent (wt %).

Phosphorus-Based Wear Preventative

Embodiments may also include one or more phosphorus-based wear preventatives. The phosphorus-based wear preventative may comprise a metal dihydrocarbyl dithiophosphate compound, such as but not limited to a zinc dihydrocarbyl dithiophosphate compound. Suitable metal dihydrocarbyl dithiophosphates may comprise dihydrocarbyl dithiophosphate metal salts wherein the metal may be an alkali or alkaline earth metal, or aluminum, lead, tin, molybdenum, manganese, nickel, copper, or zinc. The zinc salts are most commonly used in lubricating oil.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The zinc dihydrocarbyl dithiophosphates (ZDDP) are oil soluble salts of dihydrocarbyl dithiophosphoric acids and may be represented by the following formula:

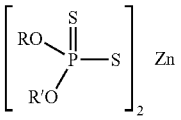

wherein R and R' may be the same or different hydrocarbyl radicals containing from 1 to 18, for example 2 to 12, carbon atoms and including radicals such as alkyl, alkenyl, aryl, arylalkyl, alkaryl, and cycloaliphatic radicals. R and R' groups may be alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. The zinc dihydrocarbyl dithiophosphate can therefore comprise zinc dialkyl dithiophosphates.

Other suitable components that may be utilized as the phosphorus-based wear preventative include any suitable organophosphorus compound, such as but not limited to, phosphates, thiophosphates, phosphites, and salts thereof and phosphonates. Suitable examples are tricresyl phosphate (TCP), di-alkyl phosphite (e.g., dibutyl hydrogen phosphite), and amyl acid phosphate.

Suitable phosphorus-based wear preventatives may also include one or more phosphites. The phosphite may comprise any suitable oil soluble phosphite. The phosphite may comprise dioleyl hydrogen phosphite. Further the phosphite may comprise any alkyl phosphite wherein the alkyl chain contains about 5 carbon atoms or more. In some embodiments, the phosphite may comprise a dihydrogen phosphite. The phosphite may be present in a fluid composition according to the disclosed embodiments in an amount from about 0.01 to about 0.5 wt %.

Extreme Pressure Agent

In some embodiments, a fluid may include an extreme pressure agent. One or more extreme pressure agents may be included in the power transmission fluids described herein. Such compounds include thiazoles, triazoles, and thiadiazoles and sulfurized fatty acids and olefins. Examples include, but are not limited to, benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis (hydrocarbylthio)-1,3,4-thiadiazoles, and 2,5-bis (hydrocarbyldithio)-1,3,4-thiadiazoles.

The sulfurized fatty acids and olefins may include, but are not limited to, dihydrocarbyl polysulfides; sulfurized olefins; sulfurized fatty acid esters of both natural and synthetic origins; trithiones; sulfurized thienyl derivatives; sulfurized terpenes; sulfurized oligomers of C2-C8 monoolefins; and sulfurized Diels-Alder adducts such as those disclosed in U.S. Pat. No. Re 27,331. Specific examples include sulfurized polyisobutene, sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfide such as mixtures of di-tert-butyl trisulfide, di-tert-butyl tetrasulfide and di-tert-butyl pentasulfide, among others. Combinations of such categories of sulfur-containing antiwear and/or extreme pressure agents may also be used, such as a combination of sulfurized isobutylene and di-tert-butyl trisulfide, a combination of sulfurized isobutylene and dinonyl trisulfide, a combination of sulfurized tall oil and dibenzyl polysulfide.

The total amount of extreme pressure agent in the transmission fluids may range from about 0.01 to about 10 wt. % based on the total weight of the transmission fluid composition.

Metal Deactivator

The formulations also may contain metal deactivators, which include materials commonly used for that purpose in this general class of fluids. These may comprise, for example, ashless dialkyl thiadiazoles. Suitable dialkyl thiadiazoles may be of the general formula (I):

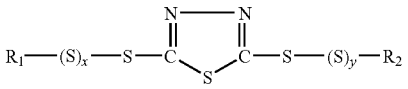

wherein $R_1$ and $R_2$ may be the same or different hydrocarbyl groups, and x and y independently may be integers from 0 to 8. In one aspect, $R_1$ and $R_2$ may be the same or different, linear, branched, or aromatic, saturated or unsaturated hydrocarbyl group having from about 6 to about 18 carbon atoms, particularly from about 8 to about 12 carbon atoms, and x and y each may be 0 or 1.

A suitable dialkyl thiadiazoles includes 2,5-bis(hydrocarbyldithio)-1,3,4-thiadiazoles. Examples of other suitable dialkyl thiadiazoles include, for example, 2,5-bis(hydrocarbylthio)-1,3,4-thiadiazoles, 2-(tert-hydrocarbyldithio)-5-mercapto-1,3,4-thiadiazoles, and bis-tert-dodecylthiothiadiazole.

Suitable dialkyl thiadiazoles also include those such as described, for example, in U.S. Pat. Nos. 4,149,982 and 4,591,645, and which descriptions are incorporated herein by reference. Mixtures of dialkyl thiadiazoles of formula (I) with moncalkyl thiadiazoles may also be used.

The fluid composition may include up to about 2.0 wt % of the metal deactivators.

Base Oil

The present embodiments may be used in combination with a major amount of a base oil. Base oils suitable for use in formulating fluid compositions according to the present disclosure may be selected from any of the synthetic oils or natural oils or gas to liquid base oils or mixtures thereof. Natural oils include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also suitable. The base oil typically has a viscosity of about 2 to less than about 7 cSt at 100° C.

The synthetic base oils include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly (1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_{3-8}$ fatty acid esters, or an oxo acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the fluid compositions as described herein may be selected from any of the base oils in Groups I-V as specified in the American Petroleum Institute (API) Base Oil Interchangeability Guidelines, as well as gas to liquid base oils. Such Group I-V base oil groups are as follows:

| Base Oil Group[1] | Sulfur (wt. %) | | Saturates (wt. %) | Viscosity index |
|---|---|---|---|---|
| Group I | >0.03 | and/or | <90 | 80 to 120 |
| Group II | ≤0.03 | And | ≥90 | 80 to 120 |
| Group III | ≤0.03 | And | ≥90 | ≥120 |
| Group IV | all polyalphaolefins (PAOs) | | | |
| Group V | all others not included in Groups I-IV | | | |

[1]Groups I-III are mineral oil base stocks.

The amount of base oil in the fluid compositions may range from about 40 to about 99 percent by weight of the fluid composition. Such amount also meets the intention of the use of the phrase "major amount" in the present specification.

Additives used in formulating the fluid compositions described herein can be blended into the base oil individually or in various sub-combinations. Further, all of the components may be blended concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The fluid compositions disclosed herein may include fluids suitable for any automatic, manual, or automated manual transmission application. For example, embodiments disclosed herein may be suitable for use in a step automatic transmission, a manual transmission, a continuously variable transmission, a dual clutch transmission, and the like. Further, the presently disclosed power transmission fluids may be suitable for use in transmissions with a slipping torque converter, a lock-up torque converter, a starting clutch, and/or one or more shifting clutches. Such transmissions include four-, five-, six-, and seven-speed transmissions, and continuously variable transmissions (chain, belt, or disk type).

An suitable fluid composition as described herein may contain the following components in the amounts indicated:

TABLE 1

| | |
|---|---|
| Antioxidant(s) | 0-0.6 wt % |
| Rust Inhibitor(s) | 0-0.25 wt % |
| EP agent(s) | 0-1.5 wt % |
| Antifoam agent(s) | 0-0.1 wt % |
| Friction Modifier(s) | 0-1.0 wt % |
| Borated/Phosphorylated Dispersant(s) | 1-6 wt % |
| Phosphorus-based wear preventative(s) | 0.01-0.5 wt % |
| Detergent(s) | 0-1 wt % |
| Seal Swell Agent(s) | 0-15 wt % |
| Polymethacrylate Viscosity Index Improver(s) | 0-25 wt % |
| Base Oil(s) | 40-99 wt % |
| Diluent Oil(s) | 2-5 wt % |

Low Speed SAE No. 2 Friction Test

Friction characteristics for the inventive and comparative fluids were investigated on a Low Speed SAE#2 machine. Tests were conducted with cellulose paper based friction material lined plates. Friction was measured and recorded at 120° C.

Friction Durability Test

Friction durability for the inventive and comparative fluids was investigated on a ZF-GK rig using the Volkswagen (VW-GK-DSG) Test to measure friction durability of fluids for dual clutch transmissions. The method comprises a dynamic friction test sequence under specified pressure and temperature ramps to determine the number cycles the fluid accomplishes under these conditions without the onset of shudder.

Example I 4.4 wt. % of a phosphorylated and boronated succinimide dispersant was combined with 0.08 wt. % of a dioleylphosphite antiwear agent, 0.3 wt. % of an overbased calcium sulfonate detergent, 0.05 wt % of a thiadiazole extreme pressure agent, and 2.17 wt. % of a core package containing a rust inhibitor, an antioxidant, an antifoam agent, friction modifiers, and a diluent oil for a total additive treat rate of 7.0 wt. %.

This mixture is added to a base oil blend that contains base oils and a viscosity index improver.

Comparative Example II

Comparative Example II is a commercially available dual clutch transmission fluid. Elemental analysis using Inductively Coupled Plasma (ICP) spectroscopy provided the sulfur, calcium, boron, and phosphorus data provided in Table II.

TABLE II

| | Example I | Example II (comparative) |
|---|---|---|
| S (ppm) | 410 | 640 |
| P (ppm) | 383 | 294 |
| B (ppm) | 163 | 139 |
| Ca (ppm) | 357 | 30 |
| S/P (ppm/ppm) | 1.2 | 2.2 |
| S/Ca (ppm/ppm) | 1.2 | 21.3 |
| S/B (ppm/ppm) | 2.5 | 4.6 |
| VW-GK-DSG DCT durability Test (Cycles without Shudder) | 40,000 | 15,000 |
| μ20/μ250 (fresh) | 0.94 | 1.04 |
| μ20/μ250 (aged) | 0.98 | 1.20 |

Table II also shows the Low Speed SAE#2 friction characteristics of inventive fluid Example I and the comparison fluid, Example II, before (fresh) and after aging (aged). In the present application aging is defined as exposing a fresh oil to 150° C. for 200 hours. After the 200 hour period, the oil is referred to as "aged." The results show that Example I retains positive friction characteristics in contrast to the comparison product, which shows a dramatic change in friction levels and slope. Friction characteristics of the comparison fluid can be expected to increase the probability for increased shift chatter and shudder. The superior durability of the inventive fluid was further demonstrated by testing both the inventive fluid, Example I, and the comparative fluid, Example II using a VW-GK-DSG DCT durability Test. As shown in Table II the inventive fluid is more than 2.5 times more durable.

The inventive fluid, therefore, provides superior friction and friction durability performance in the clutch-only portion of a dual-clutch transmission.

At numerous places throughout this specification, reference has been made to a number of U.S. patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The invention claimed is:

1. A clutch-only transmission fluid comprising:

a) an oil of lubricating viscosity formulated with additive components comprising:
   i) up to about 1 wt % of at least one overbased metal sulfonate detergent;
   ii) from about 0.01 to about 5 wt % of at least one dioleylphosphite wear preventative;
   iii) from about 1 to about 6 wt % of a phosphorylated and boronated succinimide dispersant;
   iv) from about 0.01 to about 10 wt % of a thiadiazole extreme pressure agent;

b) a ratio between the content (ppm) of the sulfur based on the total weight of the fluid composition and a content (ppm) of phosphorus based on the total weight of the fluid composition ranging from about 2.0 to about 0.5 (ppm/ppm); and c) a ratio between the content (ppm) of the sulfur based on the total weight of the fluid composition and a content (ppm) of calcium based on the total weight of the fluid composition ranging from about 10.0 to about 0.5 (ppm/ppm).

2. The composition according to claim 1, wherein said metal detergent is selected from the group consisting of calcium phenates, calcium salicylates, calcium sulfonates, and mixtures thereof.

3. The composition according to claim 1, wherein said at least one metal detergent is an overbased calcium sulfonate.

4. The composition according to claim 3, wherein said overbased calcium sulfonate has a total base number of between about 150 to about 450.

5. The composition according to claim 1, wherein said composition contains from about 50 to about 100 ppm phosphorus from the dioleylphosphite compound.

6. The composition according to claim 1, wherein said composition contains from about 50 to about 250 ppm boron from the phosphorylated and boronated dispersant.

7. The composition according to claim 1, wherein said composition has a μ20/μ250 (aged) of between about 0.95 and 1.05.

8. A method for improving the friction performance of a clutch-only transmission, which comprises: (1) adding to the clutch-only portion of the transmission the fluid composition of claim 1; and (2) operating the transmission.

9. A clutch-only additive package comprising:

a) up to about 1 wt % of at least one overbased metal sulfonate detergent;

b) from about 0.01 to about 5 wt % of at least one dioleyphosphite wear preventative;

c) from about 1 to about 6 wt % of a phosphorylated and boronated succinimide dispersant;

d) from about 0.01 to about 10 wt % of a thiadiazole extreme pressure agent; and e) a ratio between the content (ppm) of the sulfur based on the total weight of the additive package and a content (ppm) of phosphorus based on the total weight of the additive package ranging from about 2.0 to about 0.5 (ppm/ppm); and f) a ratio between the content (ppm) of the sulfur based on the total weight of the fluid composition and a content (ppm) of calcium based on the total weight of the fluid composition ranging from about 10.0 to about 0.5 (ppm/ppm).

10. A method of improving the friction durability for a dual clutch power transmission apparatus by using an effective amount of a clutch-only transmission fluid in a clutch-only fluid reservoir in communication with said dual clutch power transmission, the transmission fluid comprising a mixture of:

(1) a major amount of a lubricating oil; and (2) a friction durability improving effective amount of an additive combination comprising:

(a) up to about 1 wt % of at least one overbased metal sulfonate detergent;

(b) from about 0.01 to about 5 wt % of at least one dioleylphosphite wear preventative;

(c) from about 1 to about 6 wt % of a phosphorylated and boronated succinimide dispersant;

(d) from about 0.01 to about 10 wt % of a thiadiazole extreme pressure agent; and (e) wherein a ratio between the content (ppm) of the sulfur based on the total weight of the fluid composition and a content (ppm) of phosphorus based on the total weight of the fluid composition ranges from about 2.0 to about 0.5 (ppm/ppm); and (f) a ratio between the content (ppm) of the sulfur based on the total weight of the fluid composition and a content (ppm) of calcium based on the total weight of the fluid composition ranging from about 10.0 to about 0.5 (ppm/ppm).

11. The method of claim 10, wherein said clutch-only transmission fluid has a μ20/μ250 (aged) of between about 0.95 and 1.05.

* * * * *